US005483715A

United States Patent [19]

Fogarty et al.

[11] Patent Number: 5,483,715

[45] Date of Patent: Jan. 16, 1996

[54] VEHICLE SERVICE RAMP

[76] Inventors: William W. Fogarty, 2408 Bradley Dr., Harrisburg, Pa. 17110; Phillip M. Friday, 1923 Walnut St., Camp Hill, Pa. 17011

[21] Appl. No.: 224,759

[22] Filed: Apr. 8, 1994

[51] Int. Cl.[6] ..... E01D 1/00

[52] U.S. Cl. ..... 14/69.5; 14/71.1

[58] Field of Search ..... 14/69.5, 71.1; 254/88; 248/352

[56] References Cited

U.S. PATENT DOCUMENTS 5,033,146 7/1991 Fogarty et al. ..... 14/69.5

5,253,410 10/1993 Mortenson ..... 14/71.1 X

OTHER PUBLICATIONS

"Plastic Technology" by Robert V. Milby, 1973 pp. 244–246 and 254–255.

*Primary Examiner*—Michael Powell Buiz

[57] ABSTRACT

A vehicle service ramp comprising a unitary ramp having an external structure including a rear wall, a pair of side walls and a front. The front includes a surface sloping upward to a top flat plane. The ramp has an internal structure forming a honeycomb pattern of supporting walls extending between the rear wall, side walls and front. The ramp is formed from a foamed polymer having a tensile strength sufficient to support its rated load bearing capacity.

5 Claims, 2 Drawing Sheets

FIG. 1
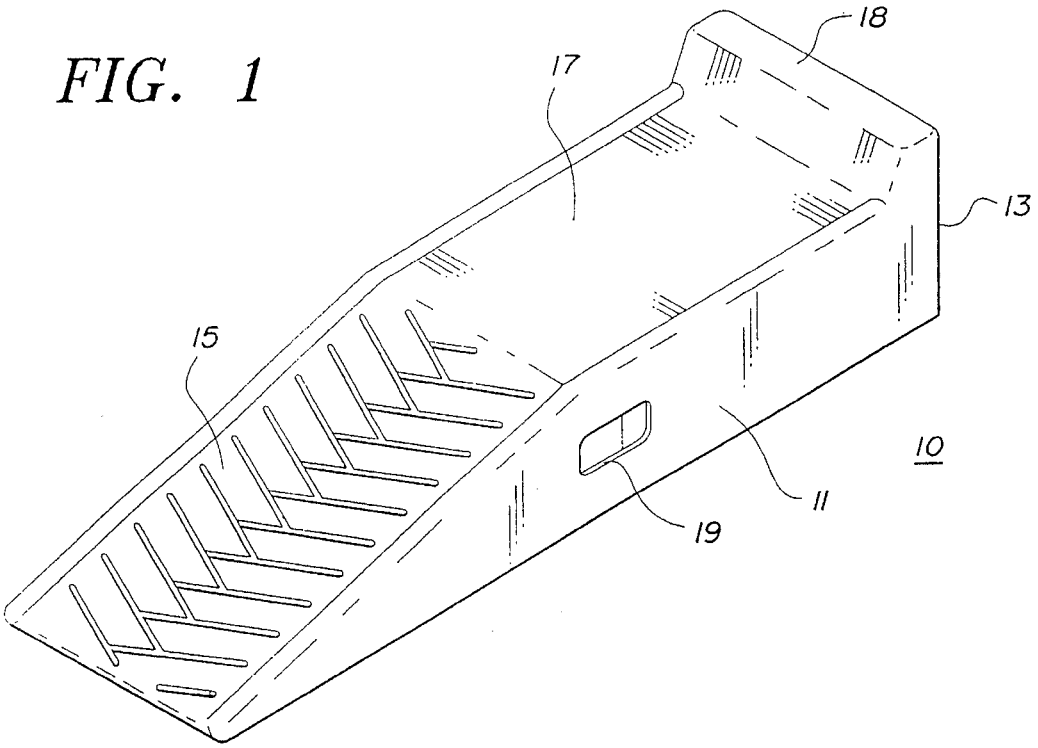
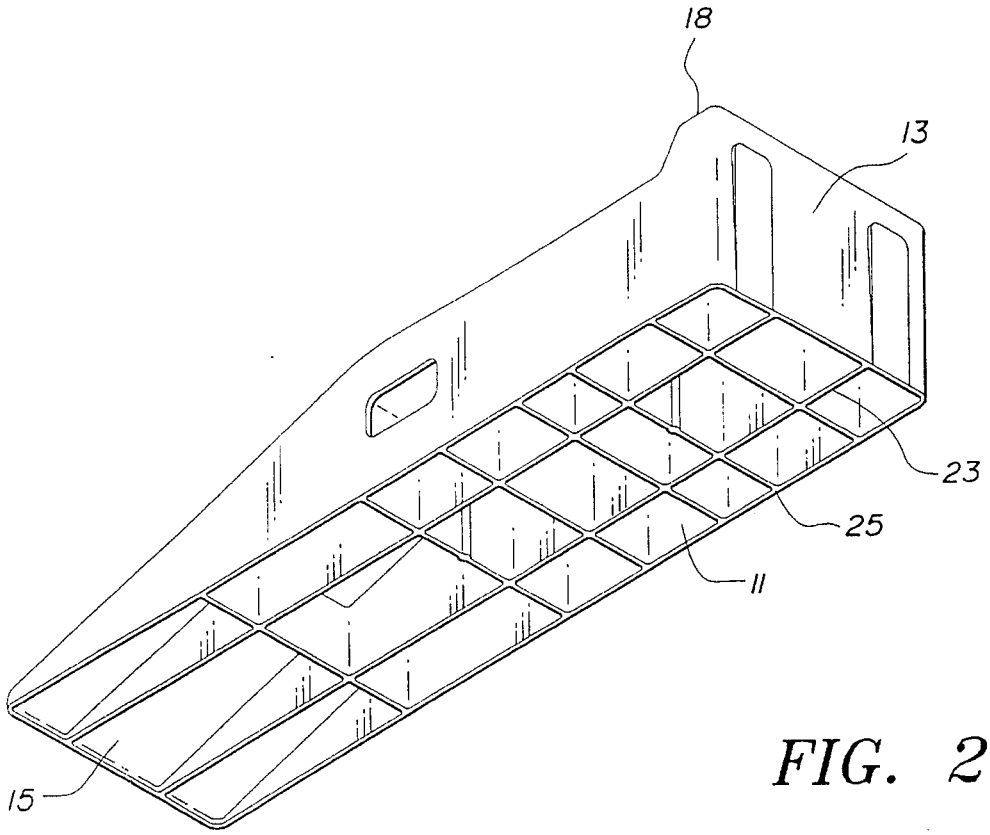
FIG. 2

VEHICLE SERVICE RAMP

FIELD OF THE INVENTION

The present invention relates to a vehicle service ramp. More particularly, the invention relates to portable ramps which provide access to the undercarriage of vehicles which are driven onto the ramps to elevate them.

BACKGROUND OF THE INVENTION

At the present time, there are a variety of devices on the market for temporarily supporting cars and trucks in an elevated position. Many are used for repairing or maintaining one's own car. Of these, the most common are hydraulic jacks, jack stands, and drive-on ramps. Jacks lift a car to provide working space underneath and jack stands support a jacked-up car. Drive-on ramps both lift and support a car. Perhaps the most attractive are the drive-on ramps because of their appearance of stability. In most cases, these devices are made from steel or, in some cases wood, because the need for strength is paramount.

Prior art ramps have been found to be unstable and prone to move away from a vehicle as it is being driven on. This movement is caused by the relatively small amount of surface contact made with the ground and the narrow base of current prior art structures. Metal ramps have been found to damage asphalt or other surfaces because they gouge into the surface and do not evenly displace the forces applied to them. Some currently available metal ramps actually instruct the user to avoid asphalt because it is too soft for the sharp metal edges. Alternatively, the metal side walls may be subjected to lateral forces as the ramp slides or sticks on the surface, causing collapse of the ramp since metal has an excellent ability to withstand compressive forces but does not resist bending well at all.

One solution to the problem has been proposed in our U.S. Pat. No. 5,033,146, issued Jul. 23, 1991. In this patent, a light weight, high strength vehicle service ramp is described in which a system of interlocking vertical cross members running longitudinally and transversely throughout the length and width of the structure provides support from side-to-side and front-to-back. The preferred structure is manufactured from dense wood such as marine grade plywood. Alternatively, it is suggested that a high strength plastic type compound could be used to form the vehicle service ramp.

As shown in our above-identified U.S. Pat. No. 5,033,146, a honeycomb like arrangement is made by setting various pieces together and attaching them to the side and back walls to form the completed ramp. Initial products of this design were manufactured from wood, as noted above, and they were found to be quite suitable as these prototype ramps were used daily in several facilities. Attempts to transform the design from wood to plastic resulted in a number of difficulties. Efforts included the use of extremely expensive engineering grade plastic resins. Attempts to create a method for molding the product led to changes in design and totally impractical production methods and materials. This endeavor was therefore totally unsuccessful in producing a vehicle service ramp from high strength plastic type compounds as suggested in our above-identified patent.

Other difficulties were encountered in contemplating the manufacture and sale of plastic ramps. Pressed metal is extremely cheap and easy to fabricate, and thus it appears that plastic ramps would be more expensive then metal ones.

Moreover, plastic has a particular problem unique to plastic in that it is known to creep, thereby causing a deformity of the polymer structure as weight is continuously applied. This defect does not occur significantly in wood or metal products.

Accordingly, an object of this invention is to produce a vehicle service ramp which does not have the inherent problem of creep, at least at weights which are expected to be encountered.

Another object of this invention is to produce a vehicle service ramp which is made from inexpensive materials.

Other objects will appear hereinafter.

SUMMARY OF THE INVENTION

It has now been discovered that the above and other objects of the present invention may be accomplished in the following manners. Specifically, an improved vehicle service ramp formed from a foamed polymer having a tensile strength of at least 500 psi and a compression strength of at least 500 psi can be manufactured in accordance with the present invention.

The ramp is unitary in construction, being formed by molding, and has an external structure including a rear wall and a pair of side walls. Also included as front, with the front including a surface sloping upward to a top surface. The ramp also has an internal structure forming a honeycomb pattern of support walls extending between the rear wall, the side walls and the front.

The support walls comprise a plurality of walls forming the honeycomb pattern. The preferred pattern is rectangular, with longitudinal walls being parallel to the side walls. Alternatively, other effective patterns are circular, ovoid and polygonal such as a diamond shaped pattern.

A variety of foamed polymers may be used for the present invention. For example, high density polyethylene, polyphenylene oxide, polycarbonate, thermoplastic polyesters, polypropylene, high impact polystyrene, polyurethane, polyvinyl chloride and the like. Of these, for the present invention, high density polyethylene is preferred.

BRIEF DESCRIPTION OF THE DRAWINGS

These and other objects of the present invention and the various features and details of the operation and construction thereof are hereinafter more fully set forth with reference to the accompanying drawings, where:

FIG. 1 is a perspective view of the preferred embodiment, shown from the side and front.

FIG. 2 is a similar perspective view of the device shown in FIG. 1, showing the bottom and inside of the device.

DETAILED DESCRIPTION OF THE PREFERRED EMBODIMENT

Figure 3:
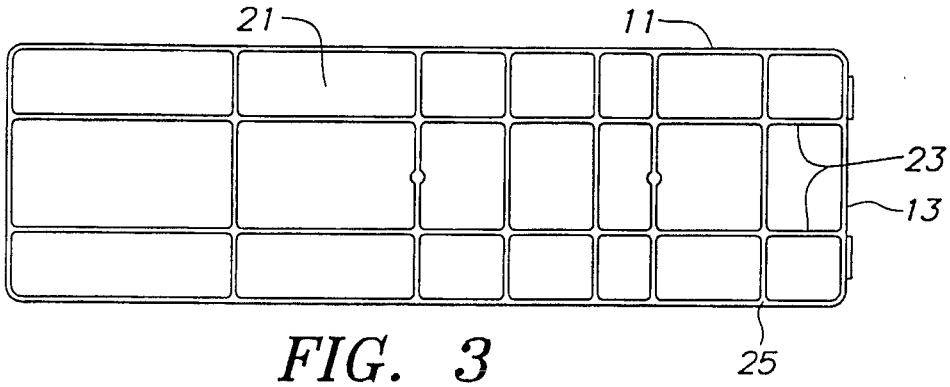
FIG. 3, FIG. 3A, FIG. 3B and FIG. 3C are views from beneath the invention of typical rectangular, circular, polygonal and ovoid shaped honeycomb patterns, showing the bottom and inside of the device.
Figure 3A:
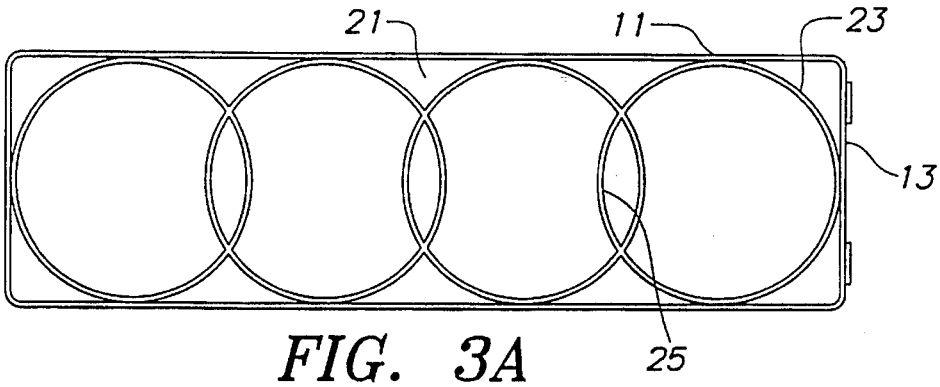
Figure 3B:
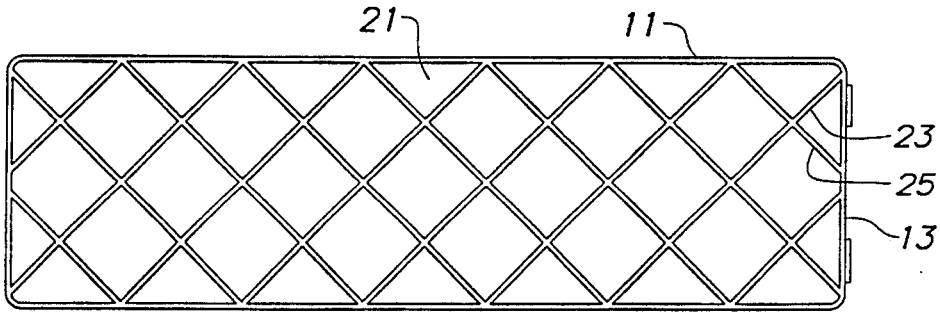
Figure 3C:
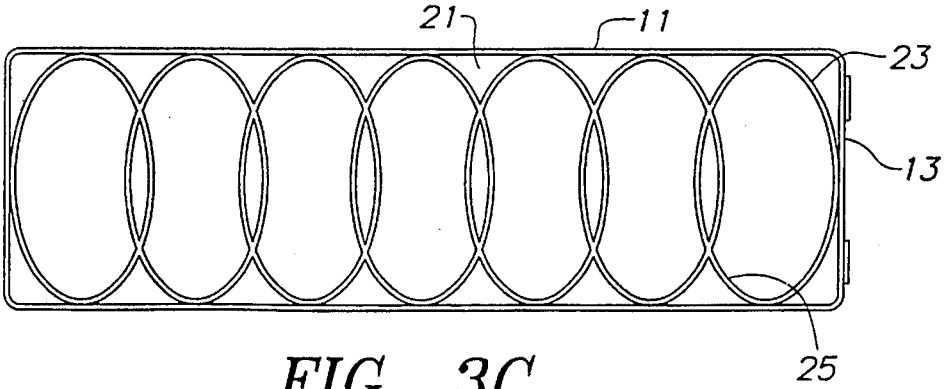

The ramp of the present invention is shown generally by the reference numeral 10. The unitary ramp includes a pair of side walls 11 and a rear wall 13. The front of the ramp includes an upward sloping surface 15 and a top plane surface 17 on which the tire of the vehicle is to rest. Stop 18 is provided to assist in orienting the vehicle. The device includes hand grips 19 for facilitating the placement and movement of the ramp. In the interior 21 of the ramp, a honeycomb pattern is formed from support walls, shown in FIG. 2 as longitudinal walls 23 between the back 13 and the front 15 and as transverse walls 25 between the side walls 11. These longitudinal walls 23 and transverse walls 25 from a honeycomb pattern in the interior 21 of the ramp such that all of the internal walls 23 and 25 contact the surface on which the ramp is placed as do the bottoms of the side walls 11, rear wall 13 and the tip of the sloping surface 15. As total contact with the surface on which the ramp is placed distributes the weight evenly and effectively, and provides sufficient contact so that the ramp does not move when a vehicle is driven onto the ramp.

As will be appreciated, internal walls 23 and 25 can also be formed in other honeycomb patterns, such as curved, ovoid, circular or polygonal, diamond or other shaped patterns. Since the device is molded, economy suggests that the rectangular pattern shown in FIG. 2 is most practical. However, other patterns are within the scope of the present invention.

Internal walls 23 and 25 are subjected to compression by the weight of the vehicle as it drives up onto the top surface 17. In addition, all of the walls are subjected to tensile stresses as weight is transferred throughout the honeycomb structure, so that both tensile strength and compression strength are important in providing a design which is capable of functioning effectively and efficiently in the commercial market place. Accordingly, the foamed polymer should have a tensile strength of at least 500 psi and preferably 1200 psi and a compression strength of at least 500 psi and preferably 1800 psi. In any case, the values for tensile strength and compression strength must provide sufficient strength for the completed ramp to support the rated load bearing capacity.

As mentioned above, a plurality of foamed polymers may be used in the present invention. Among these are high density polyethylene, polyphenylene oxide, polycarbonate, thermoplastic polyesters, polypropylene, high impact polystyrene, polyurethane, polyvinyl chloride and the like. High density polyethylene is preferred.

Both thermoplastic and thermoset types of plastics can be used to produce structural foam. Production of foamed polymers can be accomplished by many different processes, which can be broken down into three major categories. These categories are low pressure methods, high pressure methods and modified molding methods. In these processes, the word "pressure" is used to describe the cavity pressure of the melt in the mold, not the clamp or injection pressure. Low pressure foam is defined as a process using a thermoplastic, a blowing agent and a molding system designed to fill a mold cavity with an expanding resin. This results in foamed, molded plastic parts with a swirled surface caused by the gas which gets trapped between the skin and the mold surface. The high pressure structural foam process is achieved by blending a chemical blowing agent with the plastic and then filling the mold using high pressure such as in injection molding. A portion of the mold is expanded hydraulically to allow the blowing agent to foam and form a cellular center structure. The third class, modified molding methods is really a catch-all collection of processes such as co-injection or sandwich molding, counter pressure molding and the like. Any conventional method for producing foamed structures in molds can be used for the present invention, provided that the end product has the above required tensile strength of at least 500 psi and preferably 1200 psi and compression strength of at least 500 psi and preferably 1800 psi.

In order to demonstrate the effectiveness of the present invention, tests were preformed on vehicle service ramps made according to the present invention. The results of tests with these sample ramps were surprising and superior.

The first test which was conducted was to determine the capacity of a single ramp formed of high density polyethylene having a tensile strength of 1310 psi and a compression strength of 1840 psi. A hydraulic cylinder was positioned vertically on a load frame and a load cell was attached to the piston of the cylinder. A ramp was placed under the cylinder and the steel pad was lowered to touch the ramp. The pad was centered on the ramp and the load was slowly increased until failure. It was determined that the ramp itself was permanently damaged at a load of 26,090 pounds. This value was surprisingly high and means that a pair of ramps according to the present invention can support 104,000 pounds gross vehicle weight. When rated at one-eighth of its test load beating capacity, or 12,000 pounds gross vehicles weight per pair, a truly superior product is achieved. This rated capacity is almost twice as high as most conventional metal ramps currently on the market. In addition, an 8 to 1 margin of safety is included in this design, which very favorably compares to metal ramps which fail in some cases at less than 2½ times their rated capacity.

Because many users will not have the vehicle centered exactly in the proper place on the ramp, a second test was done to determine off center load capacity. Using the same test equipment described above, a load was applied on one side of the top of the ramp, so that substantially all of the force was on one side. The load again was slowly increased until failure, this time at a load of 21,660 pounds, thereby demonstrating that the device, even when misused, has a safety factor much beyond its rated capacity.

A second series of tests were preformed to evaluate the present invention. It is known that polymer products placed under stress have a tendency to stretch, a process known in the plastic world as "creep" . To evaluate this, creep testing was preformed using a 19,000 pound gross vehicle weight dump truck. This load is 7,000 pounds more than the rating for the pair of ramps. Tests were begun on Aug. 17, 1993 and continued into April, 1994. The truck was driven onto the ramps as they are intended to be used on Aug. 17, 1993, at which time the temperature was 90° F. and high humidity. On Aug. 26, 1993, the load was removed and evaluated. There was no sign of creep. Evaluation was repeated on Sep. 3, 1993 and Sep. 10, 1993, again with no sign of creep. Finally, on Oct. 28, 1993, the load was removed and the first signs of creep were noticed. The support structure was still sound however, and the load was reapplied. Finally, on Jan. 10, 1994, the load was again removed and inspected. After nearly five months of sustained heavy loading, creep remained negligible and no damage to the support structure was found. The load was then reapplied and the test continues.

This is, of course, an exaggerated test. Users are unlikely to leave a vehicle for five (5) months on a pair of vehicle ramps. However, this concentrated stress indicates that a long time service record can be expected with these products with virtually no limit to their expected lifetime.

Even though particular embodiments of the present invention have been illustrated and described herein, it is not intended to limit the invention and changes and modification may be made therein within the scope of the following claims.

What is claimed is:

1. A vehicle service ramp, comprising:

a unitary ramp having an external structure including a rear wall, a pair of side walls and a front, said front including a surface sloping upward to a top surface; said ramp having an internal structure forming a honeycomb pattern of supporting walls extending between said rear wall, side walls and front; said ramp being formed from a foamed polymer having tensile strength and a compression strength sufficient to support its rated load bearing capacity.

2. The ramp of claim 1 wherein said support walls comprise a plurality of longitudinal and transverse walls forming said honeycomb pattern.

3. The ramp of claim 2 wherein said pattern is rectangular, with said longitudinal walls being parallel to said side walls.

4. The ramp of claim 2 wherein said pattern is selected from curved, ovoid, circular, diamond or other polygonal shaped patterns.

5. The ramp of claim 1 wherein said polymer is foamed high density polyethylene.

* * * * *